US010317130B2

(12) United States Patent
Alt et al.

(10) Patent No.: US 10,317,130 B2
(45) Date of Patent: Jun. 11, 2019

(54) REFRIGERATION APPLIANCE HAVING A LIGHT

(71) Applicant: BSH HAUSGERAETE GMBH, Munich (DE)

(72) Inventors: René Alt, Munich (DE); Christoph Becke, Grosskarolinenfeld (DE); Max Eicher, Munich (DE); Christine Hartwein, Munich (DE); Maike Kirschbaum, Munich (DE); Ralph Staud, Munich (DE); Thomas Tischer, Haar (DE); Matthias Wiedenmann, Neenstetten (DE)

(73) Assignee: BSH Hausgeraete GmbH, Munich (DE)

( * ) Notice: Subject to any disclaimer, the term of this patent is extended or adjusted under 35 U.S.C. 154(b) by 399 days.

(21) Appl. No.: 15/103,687

(22) PCT Filed: Dec. 10, 2014

(86) PCT No.: PCT/EP2014/077106
§ 371 (c)(1),
(2) Date: Jun. 10, 2016

(87) PCT Pub. No.: WO2015/086632
PCT Pub. Date: Jun. 18, 2015

(65) Prior Publication Data

US 2016/0313051 A1 Oct. 27, 2016

(30) Foreign Application Priority Data

Dec. 13, 2013 (DE) ..... 10 2013 225 841

(51) Int. Cl.
*F21V 33/00* (2006.01)
*F25D 25/02* (2006.01)
(Continued)

(52) U.S. Cl.
CPC ..... *F25D 27/00* (2013.01); *F21V 33/0012* (2013.01); *F21W 2131/305* (2013.01); *F21Y 2115/10* (2016.08); *F25D 25/025* (2013.01)

(58) Field of Classification Search
CPC .. F25D 27/00; F25D 25/025; F21W 2131/305
See application file for complete search history.

(56) References Cited

U.S. PATENT DOCUMENTS 5,873,646 A 2/1999 Fjaestad et al.
8,037,706 B2 10/2011 Görz et al.
(Continued)

FOREIGN PATENT DOCUMENTS

CN 101321997 A 12/2008
CN 1021317723 A 1/2012
(Continued)

*Primary Examiner* — William N Harris
(74) *Attorney, Agent, or Firm* — Laurence A. Greenberg; Werner H. Stemer; Ralph E. Locher

(57) ABSTRACT

A refrigeration appliance includes a body having a cooling chamber which can be closed at a door opening by a door attached to the body. The refrigeration appliance has a light and storage shelves in the cooling chamber which are spaced apart from the door opening by a spacing leaving a clear space between the door opening and the storage shelves. A drawer disposed underneath the storage shelves projects into the clear space when pushed in and the drawer has side walls and a front edge. The light is a spotlight for emitting light within a cone of light so that the center of the front edge of the drawer is located within the cone of light and the side walls of the drawer are located outside the cone of light.

14 Claims, 4 Drawing Sheets

(51) Int. Cl.

| | |
|---|---|
| ***F25D 27/00*** | (2006.01) |
| ***F21Y 115/10*** | (2016.01) |
| ***F21W 131/305*** | (2006.01) |

(56) References Cited

U.S. PATENT DOCUMENTS

| | | | | |
|---|---|---|---|---|
| 2002/0089842 | A1* | 7/2002 | Santosuosso | A47F 3/001 362/92 |
| 2007/0223226 | A1* | 9/2007 | Park | H01L 25/0753 362/267 |
| 2008/0205043 | A1* | 8/2008 | Shibusawa | A47F 3/001 362/125 |
| 2014/0320040 | A1* | 10/2014 | Katu | F25D 27/00 315/292 |
| 2016/0153706 | A1* | 6/2016 | Staedel | F25D 27/00 312/407 |

FOREIGN PATENT DOCUMENTS

| | | | |
|---|---|---|---|
| CN | 103363775 | A | 10/2013 |
| DE | 3238152 | C1 | 12/1986 |
| DE | 202005011279 | U1 | 9/2006 |
| DE | 102009000848 | A1 | 8/2010 |
| EP | 0813034 | A2 | 12/1997 |
| EP | 2131128 | A1 | 12/2009 |
| EP | 2317264 | A1 | 5/2011 |
| JP | 2003075060 | A | 3/2003 |
| JP | 2006132877 | A | 5/2006 |
| JP | 2012026678 | A | 2/2012 |
| JP | 2013019657 | A | 1/2013 |
| KR | 20110045445 | A | 5/2011 |

* cited by examiner

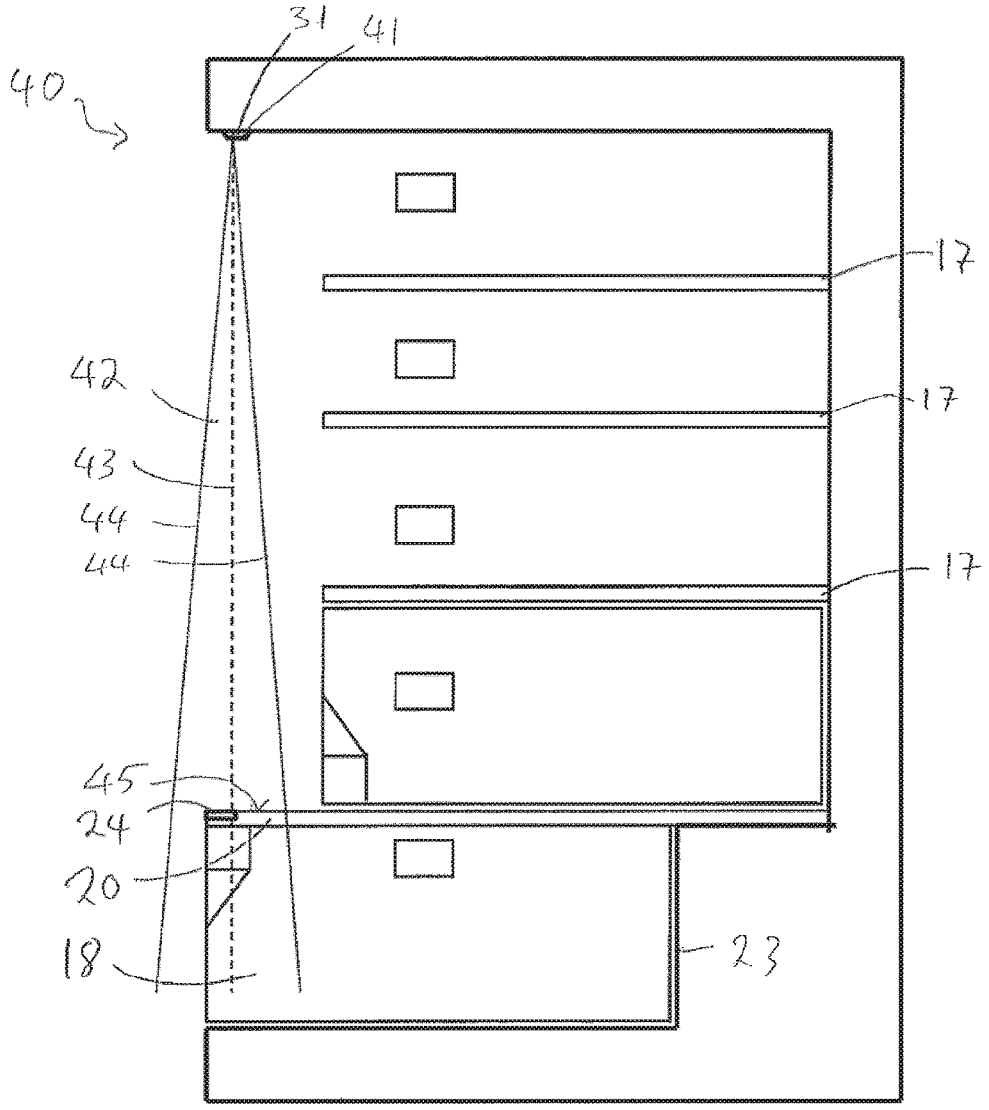
Fig. 2
Fig. 3
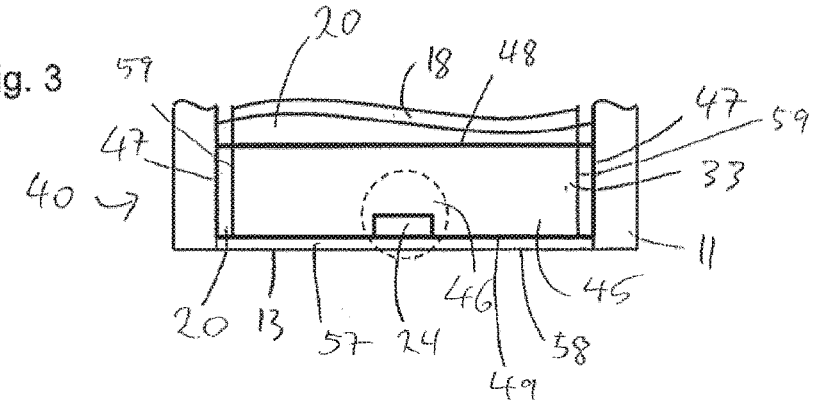

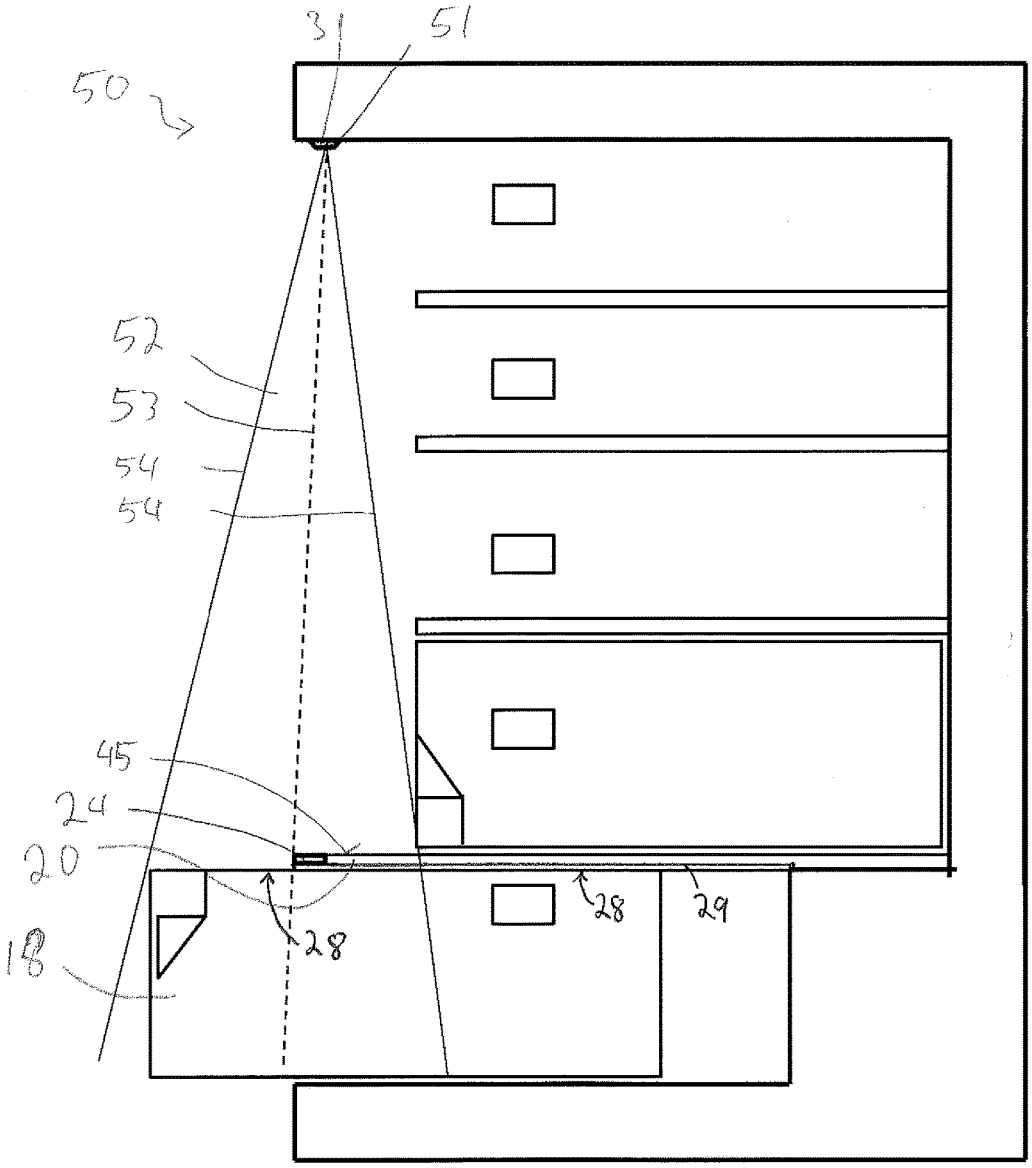
Fig. 4
Fig. 5
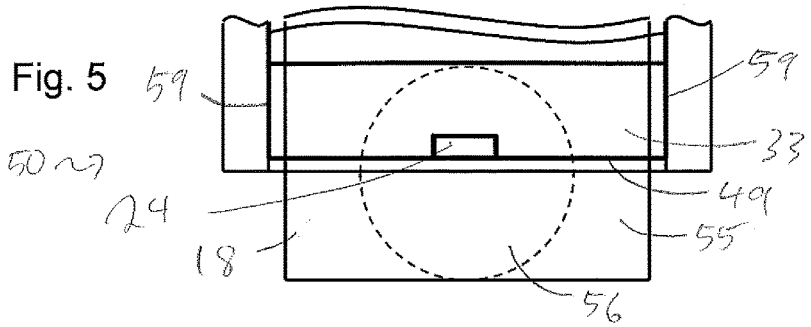

REFRIGERATION APPLIANCE HAVING A LIGHT

BACKGROUND OF THE INVENTION

Field of the Invention

The present invention relates to a refrigeration appliance having a light, in particular a domestic refrigeration appliance.

The storage space for refrigerated goods in a domestic refrigeration appliance is generally illuminated by means of one or more lights which are arranged on a side wall of an internal compartment. Trays and/or drawers in the lower region of the storage space generally do not receive any separate illumination and are correspondingly poorly lit.

EP 2 131 128 discloses a refrigeration appliance having lights on the front faces of dividing walls which in each case illuminate a drawer arranged below the dividing wall. In this case, a light cone of a light is oriented to the rear with a small angle into the tray which is in the pushed-in position. A light cone is also oriented to the front with a large angle into the tray when said tray is in the pulled-out position.

JP 2003 075 060 represents refrigeration appliances having a ceiling light which illuminates refrigerated goods in the front region of storage shelves as well as refrigerated goods in a tray if said tray is in the pulled-out position.

The lights according to the prior art produce a uniform illumination of the front region of the lowermost tray but a local region is not highlighted.

BRIEF SUMMARY OF THE INVENTION

It is the object of the present invention to provide a refrigeration appliance having a light which highlights a local region of the lowermost tray.

This object is achieved according to the invention by a refrigeration appliance according to the invention having a body which includes a cooling chamber which is able to be closed at a door opening by means of a door articulated to the body, having a light, having storage shelves in the cooling chamber which are spaced apart from the door opening by a spacing, wherein a free space is present between the door opening and the storage shelves, and having a tray which is arranged below the storage shelves and which projects into the free space in the pushed-in position and which has side walls and a front edge. The light is a spotlight for radiating light inside a light cone, wherein the center of the front edge of the tray is located inside the light cone and the side walls of the tray are located outside the light cone.

The light cone may be understood as a feature of the design and positioning of the light, irrespective of whether the light is in operation. If the light is in operation, the light cone may be identified in the simplest manner, since the light radiated by the light is substantially conducted inside the light cone.

The refrigeration appliance according to the invention highlights the region around the center of the front edge of the tray in the pushed-in position by high-contrast illumination relative to the side regions. The high-contrast lighting of the center of the tray has the advantage that refrigerated goods stored at the front in the center of the tray are very clearly visible and optically highlighted.

The tray which is arranged below the storage shelves and which in the pushed-in position projects into the free space, i.e. substantially utilizes the depth region from the door opening to the rear wall, is generally a tray for fresh food, in particular vegetables which deteriorate rapidly. Here, it is a particularly big advantage that this food is presented highlighted to the user of the refrigeration appliance.

Embodiments of the refrigeration appliance according to the invention which are advantageous, either individually or in combination, are disclosed hereinafter.

A preferred embodiment of the invention is a refrigeration appliance having a tray which comprises a tray cover. By means of the tray cover, the tray forms a volume which is closed off inside the cooling chamber and which has reduced air exchange with the remainder of the cooling chamber. As a result, the refrigerated goods in the tray are protected from rapidly drying out. This is advantageously assisted by the tray and the tray cover comprising sealing elements which in the pushed-in position are adjacent to one another.

The tray projecting into the free space in front of the storage shelves is preferably the lowermost tray in the cooling chamber. The tray cover is advantageously transparent.

Preferably, the tray cover is anchored to the body so that the tray is able to be pulled out as a drawer below the cover and the cover is able to carry objects.

In a particularly preferred embodiment of the invention, the refrigeration appliance comprises a tray with a controllable air duct which is able to control the humidity. To this end, the tray cover advantageously comprises a operating element for air exchange between the tray and a directly accessible region of the cooling chamber.

A particular advantage of the present invention is if the operating element is attached to or in the vicinity of the center of the front edge of the tray cover and thus to or in the vicinity of the center of the front edge of the tray. The operating element is then located inside the light cone and the side walls of the tray are located outside the light cone. In this embodiment, the operating element, in particular the operating element for the humidity control, is also highlighted by means of light.

Advantageously, the light is arranged on a ceiling of the cooling chamber. In this arrangement an optical axis of the light cone is located substantially vertically and the light cone is located in a free space in front of the storage shelves, where it is not obstructed by refrigerated goods on the shelves.

According to a further advantageous embodiment of the refrigeration appliance, a radius of the light cone at the height of the tray substantially corresponds to a depth of the free space in front of the storage shelves. The light cone does not necessarily have to have a circular cross section but a circular and elliptical cross section are preferred and able to be achieved by a simple projection lens.

In a preferred embodiment, a center of the light cone at the height of the tray is substantially located on the edge of the tray and/or tray cover.

In a preferred embodiment, an edge of the light cone at the height of the tray is located in the vicinity of the edge of the tray.

The light advantageously comprises a lighting means, an optical system for producing the light cone and a housing. The housing substantially prevents radiation from the lighting means to the door but permits an indicator element to the side of the light cone. Such an indicator element permits the user to view information, with a low light intensity which is considerably less than an illumination intensity for refrigerated goods in the light spot inside the light cone. The indicator element preferably has a light guide for conducting light, in particular scattered light, from the lighting means to the indicator element.

Advantageously, the housing also substantially prevents radiation from the lighting means to the storage shelves.

Further advantageous features of embodiments and aspects of the invention form the subject-matter of the subclaims and the exemplary embodiments of the invention described below. The invention is described in more detail hereinafter by means of preferred embodiments with reference to the accompanying figures, in which:

BRIEF DESCRIPTION OF THE SEVERAL VIEWS OF THE DRAWING

FIG. 2: shows a schematic view of a lateral cross section of an interior of a refrigeration appliance according to an embodiment of the invention with a narrow light cone;

FIG. 3: shows a schematic plan view of a detail of an interior of the refrigeration appliance of FIG. 2;

FIG. 4: shows a schematic view of a lateral cross section of an interior of a refrigeration appliance according to an embodiment of the invention with a broad light cone;

FIG. 5: shows a schematic plan view of a detail of an interior of the refrigeration appliance of FIG. 4;

DESCRIPTION OF THE INVENTION

Figure 1:
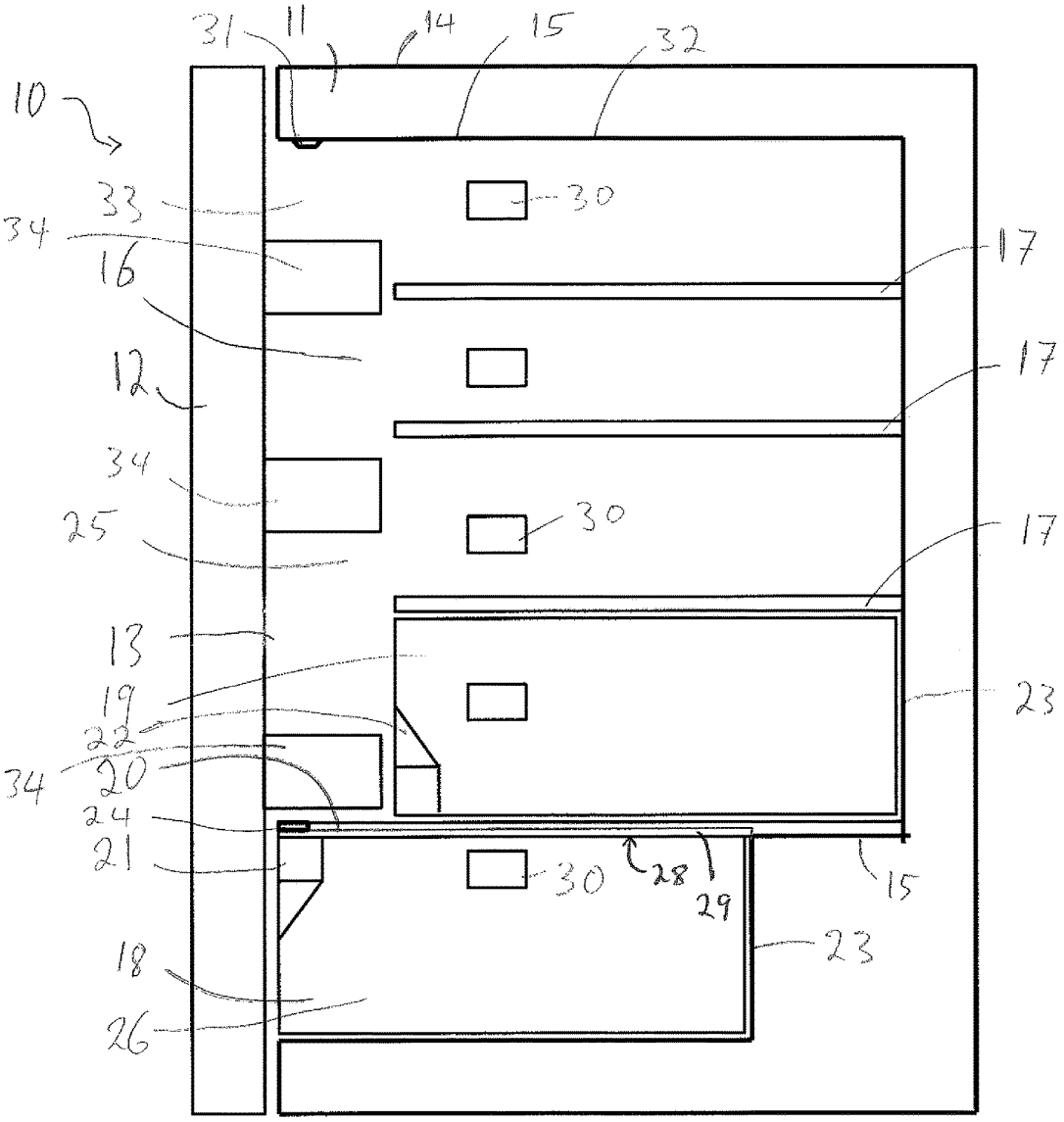
FIG. 1: shows a schematic view of a lateral cross section of a refrigeration appliance according to an embodiment of the invention.

In the figures, designs which are independent of one another are implemented in the same embodiment for the purposes of concision. Identical reference numerals in the various figures denote the same or similar-acting elements. The embodiments show a refrigerator comprising a storage space for refrigerated goods, combinations having further storage spaces, for example for frozen goods, are also encompassed by the invention.

FIG. 1 shows a refrigeration appliance 10 having a body and a door 12 which closes the door opening 13 of the body 11. The body 11 has an outer wall 14 and an internal compartment 15. The internal compartment 15 and the door opening 13 define a storage space for refrigerated goods, namely the cooling chamber 16. Storage shelves 17 are releasably fastened to the internal compartment 15 in the cooling chamber 16. The internal compartment 15 contains a tray 18 for fresh food in the form of a drawer and an open drawer 19 for further refrigerated goods.

The tray 18 is closed by a cover 20 which also forms a supporting base for the open drawer 19. A storage shelf 17 is located above the open drawer 19. The tray 18 has a handle 21 and the open drawer 19 has a handle 22. The tray 18 extends in the depth direction, substantially from the door opening 13 to a rear wall 23 of the internal compartment 15.

The cover 20 is releasably fastened to the internal compartment 15 and comprises elements regulating the air exchange. The elements regulating the air exchange comprise a operating element 24 for air exchange between a directly accessible region 25 of the cooling chamber 16 and a fresh region 26 which is defined, by the tray 18 and the cover 20.

The cover 20 also has elements, not shown, which provide a seal relative to the tray 18. Thus it is possible to influence the dehumidification of the fresh region 26 by operating the operating element 24, via the adjustment of the air exchange between the directly accessible region 25 of the cooling chamber 16 and the fresh region 26. The air in the directly accessible region 25 of the cooling chamber 16 is highly dehumidified during a normal refrigerating operation.

The refrigeration appliance 10 also has lights for illuminating the refrigerated goods, namely side wall lights 30 for lighting primarily the rear region of the cooling chamber 16 and a spotlight 31 on the ceiling 32 of the cooling chamber 16.

The spotlight 31 is arranged in the vicinity of the door opening 13 in a free space 33 between the door opening 13 and the storage shelves 17. When the door 12 is closed, the door racks 34 project into the free space 33.

The following figures show three embodiments of the refrigeration appliance 10 and namely respectively in a view of the body when the door is open, in each case as a cross section and the front region in plan view.

FIG. 2 and FIG. 3 now show on the refrigeration appliance 10 disclosed in FIG. 1, in the embodiment of the refrigeration appliance 40, an embodiment of the spotlight 31 as a spotlight 41 with a narrow light cone 42. The light cone 42 has an optical axis 43 and a light cone edge 44. When the spotlight 41 is switched on, this produces at the height of the surface 45 of the cover 20 a light spot 46, the diameter thereof corresponding to the diameter of the light cone 42 at the height of the surface 45.

In FIG. 3 the tray 18 is shown below the cover 20 in the pushed-in state. The free space 33 extends laterally between the side walls 47 of the internal compartment 15 and in the depth direction between the door opening 13 and the edge 48 of the storage shelves 17. The tray 18 extends in the depth direction substantially from the door opening 13 to a rear wall 23 of the internal compartment 15, wherein in FIG. 2 it is shown as aligned with the body, whilst in FIG. 3 a standard gap 57 is indicated between the edge 58 of the body 11 and the tray 20.

The narrow light cone 42 is designed such that the light spot 46 has a diameter of approximately the depth of the free space 33. The largest part of the light spot 46 is located behind the front edge 49 of the tray 18 and completely covers the operating element 24. The operating element 24 is located at the center of the front edge 49 of the tray 18 between the side walls 47. The spotlight 41 serves for the radiation of light inside the light cone 42, wherein the center of the front edge 49 of the tray is located inside the light cone 42 and the side walls 59 of the tray 18 are located, outside the light cone 42.

FIG. 4 and FIG. 5 now show on the refrigeration appliance 10 disclosed in FIG. 1, in the embodiment of the refrigeration appliance 50, an embodiment of the spotlight 31 as a spotlight 51 having a broad light cone 52. The light cone 52 has an optical axis 53 and a light cone edge 54. When the spotlight 51 is switched on, this produces at the height of the surface 45 of the cover 20 a light spot 56, the diameter thereof corresponding to the diameter of the light cone 52 at the height of the surface 45. The optical axis 53, in this example at the height of the surface 45, is in the vicinity of the center of the front edge of the operating element 24.

In FIG. 5, the tray 18 is shown below the cover 20 in a partially pulled-out state. The broad light cone 52 is designed such that the light spot 56 has a circular cross section with a diameter of approximately double the depth of the free space 33. The largest part of the light spot 56 is located in the pulled-out region 55 of the tray 18 and entirely covers the operating element 24. The spotlight 51 serves for the radiation of light inside the light cone 52, wherein the center of the front edge 49 of the tray 18 is located inside the light cone 52 and the side walls 59 of the tray 18 are located outside the light cone 52.

Figure 6:
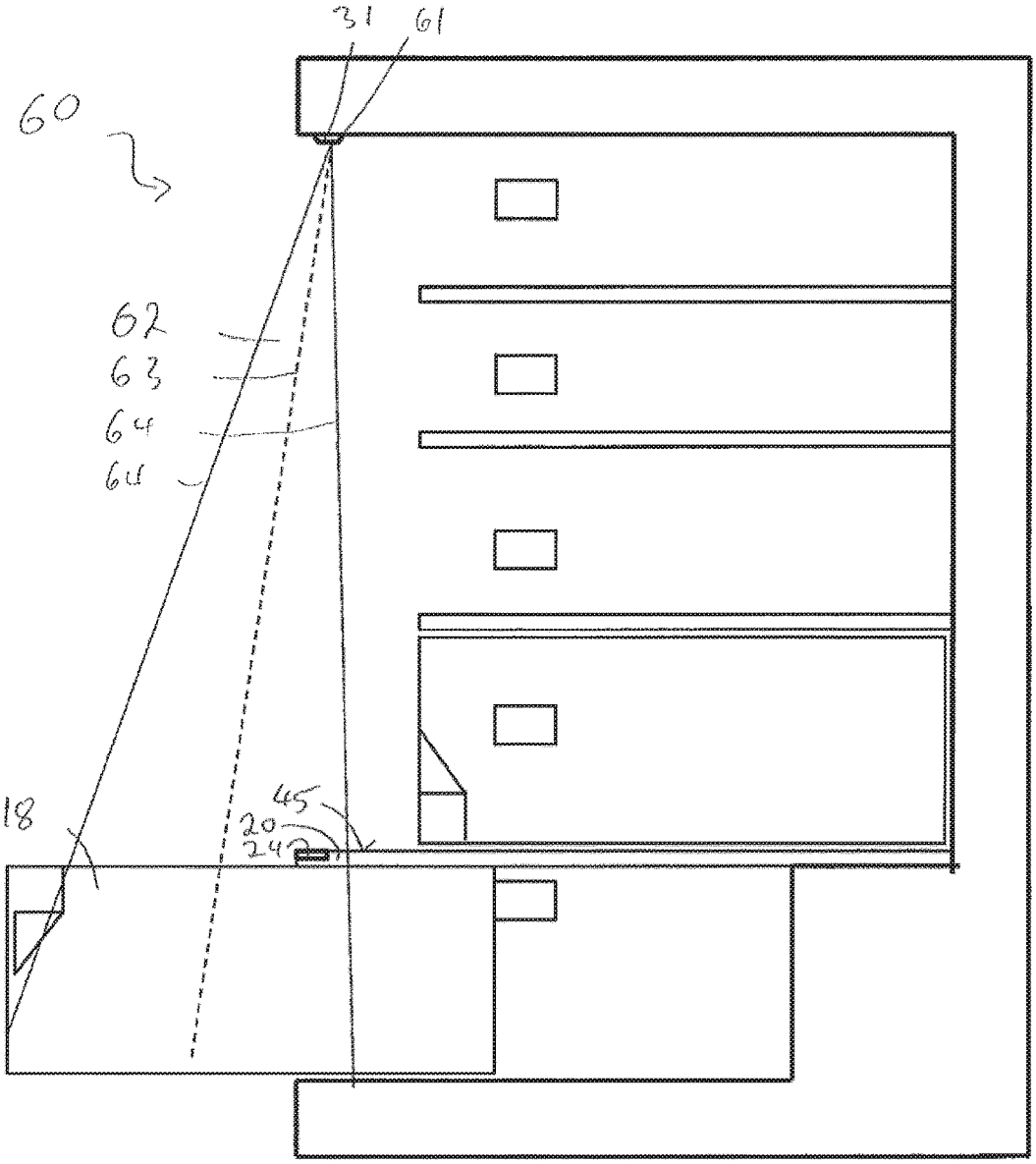
FIG. 6: shows a schematic view of a lateral cross section of an interior of a refrigeration appliance according to an embodiment of the invention with a broad light cone oriented to the front.
Figure 7:
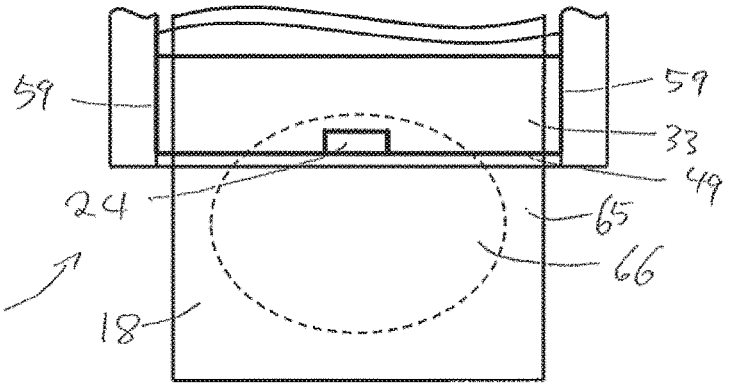
FIG. 7: shows a schematic plan view of a detail of an interior of the refrigeration appliance of FIG. 6.

FIG. 6 and FIG. 7 now show on the refrigeration appliance 10 disclosed in FIG. 1, in the embodiment of the refrigeration appliance 60, an embodiment of the spotlight 31 as a spotlight 61 having a broad light cone 62 which is inclined to the front relative to a vertical line. The light cone 62 has an optical axis 63 and a light cone edge 64. When the spotlight 61 is switched on, this produces at the height of the surface 45 of the cover 20 a light spot 66, the diameter thereof corresponding to the diameter of the light cone 62 at the height of the surface 45. The optical axis 63 in this example is inclined relative to a vertical line and is located at the height of the surface 45 outside the cooling chamber.

In FIG. 7 the tray 18 is shown below the cover 20 in the fully pulled-out state. The broad light cone 62 is designed such that the light spot 66 has an elliptical cross section, with a small extent in the depth direction, having approximately double the depth of the free space 33. The largest part of the light spot 66 is located in the pulled-out region 65 of the tray 18 and entirely covers the operating element 24. The spotlight 61 serves for the radiation of light inside the light cone 62, wherein the center of the front edge 49 of the tray 18 is located inside the light cone 62 and the side walls 59 of the tray 18 are located outside the light cone 62.

These examples show how an illumination of the operating element 24 may be combined and varied by the design of the light cone to achieve differently desired lighting of the tray 18 for fresh food.

Figure 8:
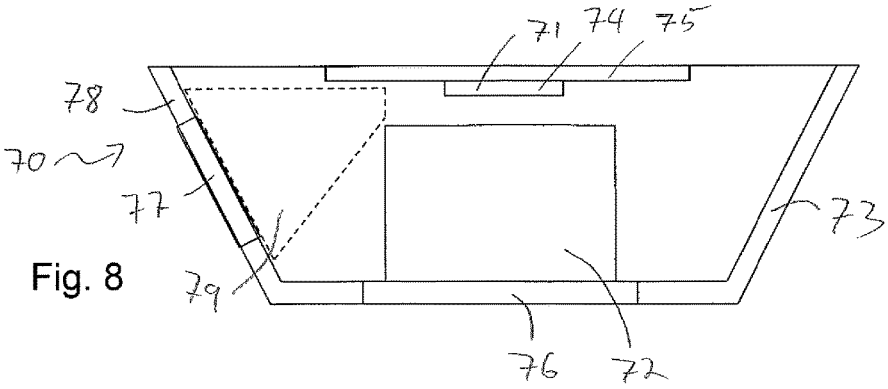
FIG. 8: shows a schematic view of a light according to an embodiment of the invention.

FIG. 8 shows a schematic view of a spotlight 70 according to an embodiment of the invention, as it may be used as a spotlight 31 according to the above examples.

The spotlight 70 has a lighting means 71, an optical system 72 for producing the light cone and a housing 73. The housing 73 receives the further components of the light and causes the radiation from the lighting means to the door and toward the storage shelves to be substantially obstructed.

The lighting means 71 in this case is an LED 74 on a printed circuit board 75. The optical system 72 in this case is protected by a light outlet aperture 76 terminating flush with the housing 73.

The spotlight 70 also has an indicator element 77 to the side of the light cone in the housing 73. The indicator element 77 permits a user to view information on a side wall 78 of the housing 73 with a low light intensity which is considerably less than an illumination intensity for refrigerated goods in the light spot. The housing 73 has a light guide 79 for guiding light, in particular scattered light, from the lighting means 71 to the indicator element 77.

LIST OF REFERENCE NUMERALS

10 Refrigeration appliance
11 Body
12 Door
13 Door opening
14 Outer wall
15 Internal compartment
16 Cooling chamber
17 Storage shelf
18 Tray
19 Open drawer
20 Cover
21 Handle
22 Handle
23 Rear wall
24 Operating element
25 Directly accessible region
26 Fresh region
30 Side wall light
31 Spotlight
32 Ceiling
33 Free space
34 Door rack
40 Refrigeration appliance
41 Spotlight
42 Light cone
43 Optical axis
44 Light cone edge
45 Surface
46 Light spot
47 Side wall
48 Edge
49 Front edge
50 Refrigeration appliance
51 Spotlight
52 Light cone
53 Optical axis
54 Light cone edge
55 Pulled-out region
56 Light spot
57 Gap
58 Edge
59 Side wall
60 Refrigeration appliance
61 Spotlight
62 Light cone
63 Optical axis
64 Light cone edge
65 Pulled-out region
66 Light spot
70 Spotlight
71 Lighting means
72 Optical system
73 Housing
74 LED
75 Printed circuit board
76 Light outlet aperture
77 Indicator element
78 Side wall
79 Light guide

The invention claimed is:

1. A refrigeration appliance, comprising:

a body defining a cooling chamber and a door opening, said cooling chamber having a directly accessible region;

a door articulated to said body for closing said cooling chamber at said door opening;

storage shelves disposed in said cooling chamber and spaced apart from said door opening by a spacing defining a free space located between said door opening and said storage shelves;

a spotlight for radiating light inside a light cone; and a tray disposed below said storage shelves and projecting into said free space in a pushed-in position of said tray, said tray having side walls located outside said light cone and a front edge with a center located inside said light cone, said tray having a transparent tray cover and said tray cover including an operator for an air exchange between said tray and said directly accessible region.

2. The refrigeration appliance according to claim 1, wherein said tray has a height, said free space has a depth, and said light cone has a diameter at said height of said tray corresponding substantially to said depth of said free space.

3. The refrigeration appliance according to claim 1, wherein said tray has a height, said free space has a depth, and said light cone has a radius at said height of said tray substantially corresponding to said depth of said free space.

4. The refrigeration appliance according to claim 1, wherein said tray has a height, and said light cone has a center at said height of said tray being substantially located on said front edge of said tray.

5. The refrigeration appliance according to claim 1, wherein said tray has a height, and said light cone has an edge at said height of said tray being located adjacent said front edge of said tray.

6. The refrigeration appliance according to claim 1, wherein said cooling chamber has a ceiling on which said spotlight is disposed.

7. The refrigeration appliance according to claim 1, wherein said light cone has an optical axis being inclined relative to a vertical line.

8. The refrigeration appliance according to claim 1, wherein said light cone has an optical axis being inclined relative to said front edge of said tray.

9. A refrigeration appliance, comprising:

a body defining a cooling chamber and a door opening;

a door articulated to said body for closing said cooling chamber at said door opening;

storage shelves disposed in said cooling chamber and spaced apart from said door opening by a spacing defining a free space located between said door opening and said storage shelves;

a spotlight for radiating light inside a light cone; and a tray disposed below said storage shelves and projecting into said free space in a pushed-in position of said tray, said tray having side walls located outside said light cone and a front edge with a center located inside said light cone, said tray having a transparent tray cover and said tray and said tray cover including sealing elements being mutually adjacent in said pushed-in position.

10. A refrigeration appliance, comprising:

a body defining a cooling chamber and a door opening;

a door articulated to said body for closing said cooling chamber at said door opening;

storage shelves disposed in said cooling chamber and spaced apart from said door opening by a spacing defining a free space located between said door opening and said storage shelves;

a spotlight for radiating light inside a light cone, said spotlight including a lighting device, a lens for producing said light cone, and a housing, said housing substantially preventing radiation from said lighting device to said storage shelves; and a tray disposed below said storage shelves and projecting into said free space in a pushed-in position of said tray, said tray having side walls located outside said light cone and a front edge with a center located inside said light cone.

11. The refrigeration appliance according to claim 10, wherein said housing substantially prevents radiation from said lighting device to said door.

12. A refrigeration appliance, comprising:

a body defining a cooling chamber and a door opening;

a door articulated to said body for closing said cooling chamber at said door opening;

storage shelves disposed in said cooling chamber and spaced apart from said door opening by a spacing defining a free space located between said door opening and said storage shelves;

a spotlight for radiating light inside a light cone, said spotlight including a lighting device, a lens for producing said light cone, and a housing, said housing ha; having an indicator element disposed laterally of said light cone; and a tray disposed below said storage shelves and projecting into said free space in a pushed-in position of said tray, said tray having side walls located outside said light cone and a front edge with a center located inside said light cone.

13. The refrigeration appliance according to claim 12, wherein said spotlight has a light guide for conducting light from said lighting device to said indicator element.

14. The refrigeration appliance according to claim 12, wherein said spotlight has a light guide for conducting scattered light from said lighting device to said indicator element.

* * * * *